United States Patent [19]

McGhie

[11] Patent Number: 5,018,630

[45] Date of Patent: May 28, 1991

[54] HIGH-CAPACITY LIFT CRANE ASSEMBLY

[76] Inventor: James R. McGhie, 4632 Metcalf Dr., Eagan, Minn. 55122

[21] Appl. No.: 274,351

[22] Filed: Nov. 21, 1988

[51] Int. Cl.[5] ..... B66C 23/04; B66C 23/78; B66C 23/72; E01D 15/12

[52] U.S. Cl. ..... 212/233; 212/189; 212/195; 14/2.4

[58] Field of Search ..... 212/233, 194, 189, 174, 212/179, 195, 211, 212, 223, 232, 258; 414/228, 229, 242, 258, 263, 687; 108/52.1, 55.1; 14/2.4, 69.5

[56] References Cited

U.S. PATENT DOCUMENTS

| | | | |
|---|---|---|---|
| 1,207,423 | 12/1916 | Lundin | 212/233 |
| 1,359,379 | 11/1920 | Holmes | 212/233 |
| 2,562,086 | 7/1951 | Farrell | 212/194 |
| 3,140,857 | 7/1964 | Nickles | 254/139.1 |
| 3,323,157 | 6/1967 | Vaugoyeau | 14/2.4 |
| 3,393,810 | 7/1968 | Craighead | 212/189 |
| 3,684,104 | 8/1972 | Oda et al. | 212/233 |
| 3,713,544 | 1/1973 | Wallace et al. | 212/189 |
| 3,955,684 | 5/1976 | Novotny | 212/245 |
| 4,042,115 | 8/1977 | Beduhn et al. | 212/48 |
| 4,053,060 | 10/1977 | Wilson | 212/189 |
| 4,096,961 | 6/1978 | Rocco | 414/642 |
| 4,103,783 | 8/1978 | Beduhn et al. | 212/48 |
| 4,316,548 | 2/1982 | Helm et al. | 212/196 |
| 4,449,635 | 5/1984 | Helm et al. | 212/196 |
| 4,521,932 | 6/1985 | Parramare | 14/2.4 |
| 4,537,317 | 8/1985 | Jensen | 212/189 |
| 4,601,402 | 7/1986 | Helm et al. | 212/189 |
| 4,621,385 | 11/1986 | Gillois | 14/2.4 |
| 4,729,486 | 3/1988 | Petzold et al. | 212/189 |

FOREIGN PATENT DOCUMENTS

| | | | |
|---|---|---|---|
| 8550 | 4/1956 | Fed. Rep. of Germany | 212/244 |
| 1264010 | 3/1968 | Fed. Rep. of Germany | 212/233 |
| 1961345 | 6/1971 | Fed. Rep. of Germany | 212/233 |
| 2017058 | 10/1971 | Fed. Rep. of Germany | 212/195 |
| 37870 | 4/1965 | German Democratic Rep. | 212/233 |
| 145384 | 2/1931 | Switzerland | 212/244 |
| 459430 | 3/1975 | U.S.S.R. | 212/233 |
| 197712 | 12/1977 | U.S.S.R. | 212/233 |
| 1119970 | 10/1984 | U.S.S.R. | 212/194 |
| 965320 | 7/1964 | United Kingdom | 212/194 |

OTHER PUBLICATIONS

American Hoist & Derrick Company brochure, "900 Series Sky Horse Counterbalancing Crane", Form No. 900-SHG-3.

American Hoist & Derrick Company brochure, "1100 Series Super Sky Horse Machine Specifications", Form No. 1100-SSH-6.

*Primary Examiner*—Joseph F. Peters, Jr.
*Assistant Examiner*—R. B. Johnson
*Attorney, Agent, or Firm*—Paul L. Sjoquist

[57] ABSTRACT

A high-capacity lift assembly consisting essentially of a multipurpose platform and a pair of commercially available truck cranes or crawler cranes wherein the lifting capacity of the respective cranes is combined to create an overall assembly capable of lifting an object weighing at least double the capacity of the individual cranes. The invention further includes a drive shaft to interconnect the hoists of the respective cranes to synchronize the rotation of the hoists, a mast and boom mounting arrangement to support the loading forces with the platform and an equalizing beam to distribute the load forces equally between the two truck cranes.

6 Claims, 5 Drawing Sheets

Fig. 1B.
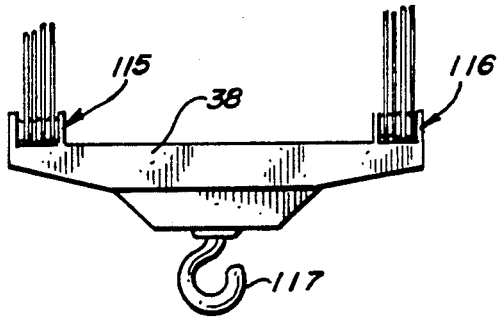
Fig. 9.
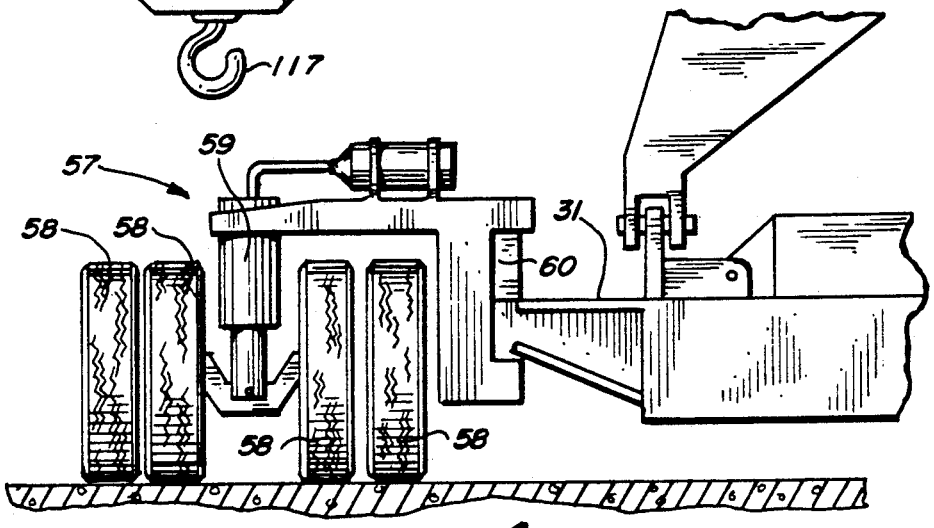
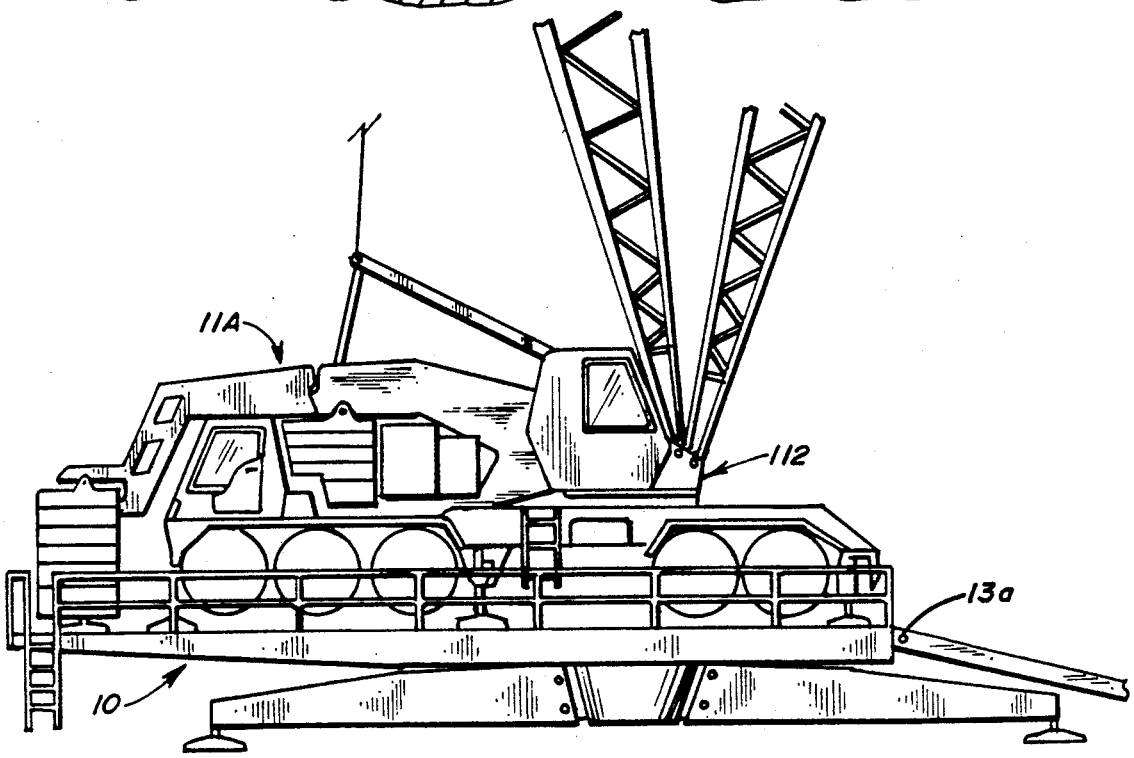
Fig. 1C.

HIGH-CAPACITY LIFT CRANE ASSEMBLY

BACKGROUND OF THE INVENTION

The present invention relates generally to a platform for use in the construction industry and more particularly a multi-purpose platform for combining the lifting capabilities of two truck cranes or crawler cranes.

Most construction companies will have one or more general, all-purpose truck cranes or crawler cranes which are capable of lifting and moving the majority of loads encountered on a typical construction project. Occasionally, certain construction projects require that a load beyond the lifting capacity of the construction company's all-purpose cranes be lifted or moved. Presently, whenever this occurs, the construction company must purchase or lease a crane having a larger lifting capacity. For most companies, the additional cost of purchasing a larger capacity crane cannot be justified merely because an occasional construction project requires the use of a high-capacity crane.

Designers of lift cranes are faced with the conflicting requirements of creating a portable crane which may be easily transported to a work site, but also creating a high-capacity crane which has sufficient versatility to perform all the usual work site tasks. The ideal high-capacity crane would be capable of performing the daily functions of the smaller cranes while having the ability to lift heavier loads whenever necessary. At present, this ideal crane has not been designed.

One example of an attempt to create an inexpensive and mobile high-capacity crane is illustrated in U.S. Pat. Nos. 4,042,115 and 4,103,783 issued to Beduhn et al. on Aug. 16, 1977 and Aug. 1, 1978, respectively. The invention disclosed in these patents consists, in part, of a mobile transporter which is designed to provide a means for moving the high-capacity crane assembly to a work site without disassembling the entire crane structure. These patents describe the desirability of having the disclosed crane assembly constructed of standard subassemblies; however, this desired construction is described in the patents as being substantially more complex and expensive than the preferred embodiment of the present invention.

Another approach to this problem is disclosed in U.S. Pat. Nos. 4,449,635 and 4,601,402 issued to Helm et al. on May 22, 1984 and July 22, 1986, respectively. These patents disclose the use of a pair of crawler assemblies wherein the front assembly pivotally supports the mast and boom assemblies while the rear assembly pivotally supports the counterweight. The pair of assemblies are independently steerable and pivotally attached to each other by one or more frame elements.

The above-described patents are representative of various approaches that have been taken to create an inexpensive and versatile high-capacity crane. The present invention is directed to the use of a multipurpose platform which will enable a construction company to combine the lifting capabilities of existing equipment to create a high-capacity assembly, and thereby avoid the expense of having to purchase a high-capacity crane having limited usefulness in the company's day-to-day operations.

SUMMARY OF THE INVENTION

An object of the present invention is to provide an inexpensive apparatus for combining the lifting capabilities of standard truck cranes or crawler cranes.

Another object of the present invention is to provide a multipurpose platform which is capable of being transported to nearly an job site.

Another object of the present invention is to provide a multipurpose platform which is sufficiently mobile to travel between various locations at a particular job site.

Another object of the present invention is to provide a multipurpose platform having the lifting and operating characteristics of a high-capacity crane.

A feature of the present invention is the use of a platform having a generally flat, top surface for rotatably supporting a pair of truck cranes or crawler cranes. The platform consists generally of a central section approximately 12 feet wide and having an overall length sufficient to support a standard 350-ton truck crane or crawler crane. Additionally, the platform includes a pair of platform sides pivotally connected to the central section to provide an overall platform surface having a sufficient width to support a pair of standard 350-ton truck cranes or crawler cranes positioned in a side-by-side relationship. The front surface of the platform includes a removable ramp to enable the truck cranes or crawler cranes to be driven onto the platform.

Another feature of the present invention is the versatility of the platform. The platform utilizes a standard high-capacity tub and swing bearing. The use of the high-capacity tub and the high-capacity swing bearing enables the entire platform to be rotated to the preferred orientation for lifting. The high-capacity tub is also removably connected to a plurality of removable outriggers which are set in place at each particular job site. Additionally, the use of removable outriggers allows the platform to be transported between job sites by merely removing the outriggers and placing them on top of the folded platform. In other embodiments, the outriggers include crawler tracks or a hydraulic suspension system to provide mobility for the platform and assembled cranes within the same job site.

A further feature of the present invention is that the entire platform may be assembled or disassembled using a standard small capacity truck crane or crawler crane, or the truck crane which is to be used with the platform. The present invention is transported between job sites using a commercially available nine-axle heavy-duty hauling system. Once the job site is reached, a standard truck crane or crawler crane may be used to assemble the platform. Initially, the hydraulics of the nine-axle hauler are used to raise the folded platform. Next, the crane lifts the outriggers from the top of the folded platform and the outriggers are attached to the high-capacity tub. Once the outriggers are in position, the folded platform is supported by the outriggers to enable the front section of the hauler to be lowered and removed from the king pin on the bottom surface of the folded platform.

Next, the crane operator lifts the ramp section of the folded platform to remove the rear section of the nine-axle hauler from the rear king pin on the bottom surface of the folded ramp. The platform sides and ramp sides are then moved from their folded position to their operational position to create a generally flat platform and ramp surface having a width dimension sufficient to support a pair of standard cranes in a side-by-side relationship.

A further feature of the present invention is that the mast and boom for each truck crane or crawler crane attaches directly to a horseshoe on an outrigger housing. This enables the downward forces from the mast and boom assemblies to be transferred directly onto the platform through an outrigger frame of the truck crane or crawler crane, and not through the crane or crane vehicle main structure. Additionally, by attaching the mast and boom directly to the outrigger horseshoes on the outrigger housing, the erection of the mast and boom is easily accomplished utilizing a retractable A-frame.

Finally, another feature of the present invention is that the lifting capabilities of the respective truck cranes or crawler cranes are coordinated by mechanically tying the hoists of each truck crane or crawler crane together using a standard drive shaft such as an automobile drive shaft. Additionally, the lift lines from the respective booms utilize a standard equalizing beam load block to balance the weight of the load placed on each boom.

An advantage of the present invention is that the lifting capacity of standard truck cranes and crawler cranes may be combined to create a high-capacity lift assembly.

Another advantage of the present invention is that the user is able to lift the heavier loads encountered in certain special projects without having to purchase a high-capacity crane having limited usefulness for typical daily projects.

Another advantage of the present invention is that the platform is relatively inexpensive, and is easily transported between job sites using a standard nine-axle heavy hauling system.

BRIEF DESCRIPTION OF THE DRAWINGS

FIG. 1B shows the equalizing beam;

FIG. 1C shows an alternative form of the invention;

FIG. 9 is a front elevation view of an alternate embodiment of the present invention.

DETAILED DESCRIPTION OF THE PREFERRED EMBODIMENT

The present invention utilizes many of the standard elements found on truck cranes and crawler cranes. Although the invention is described herein with reference to truck cranes, it should be understood that the necessary elements are also found on crawler cranes which are equally adaptable for use in the present invention.

Figure 1A:
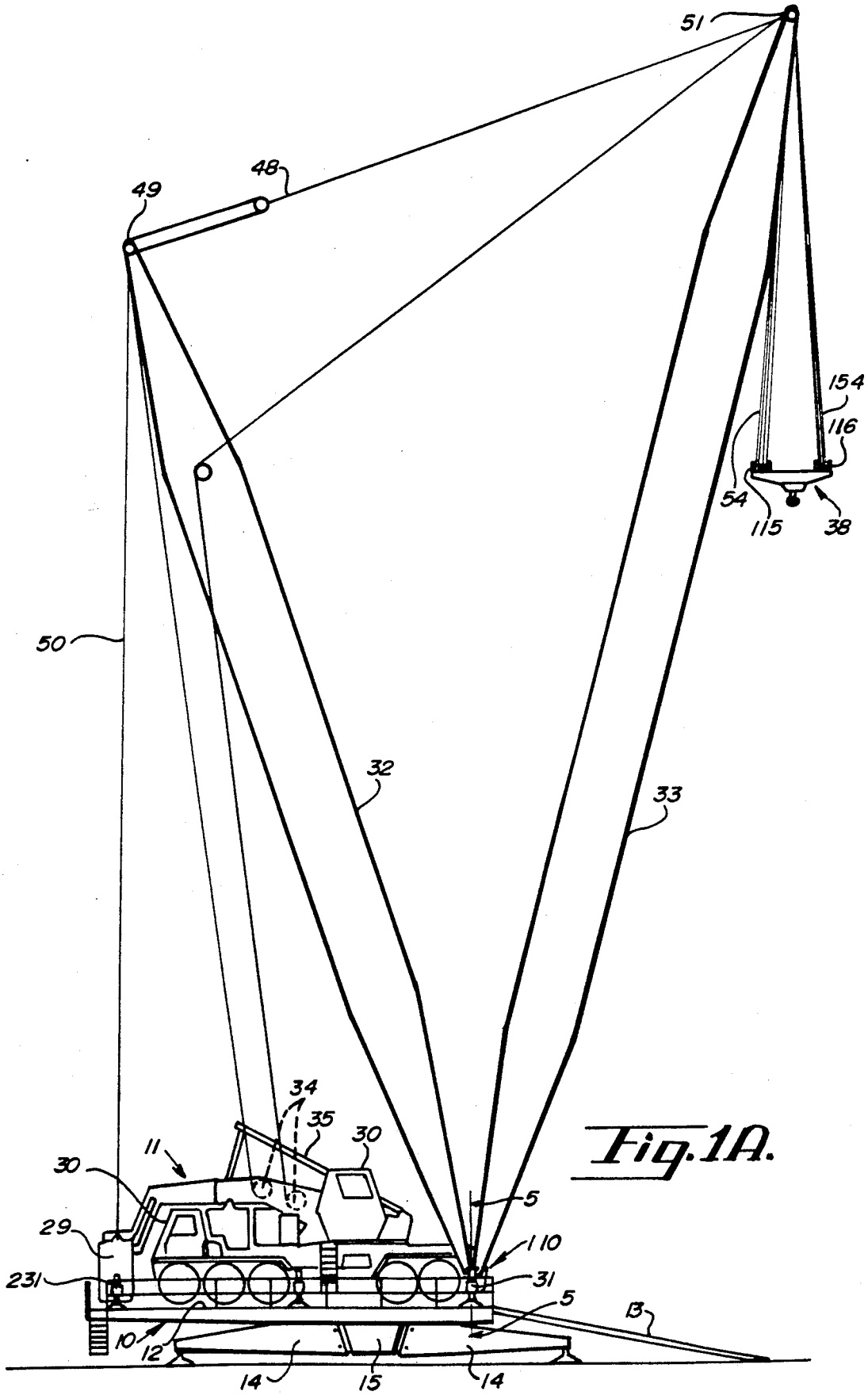
FIG. 1A is a side elevation view of the present invention.

FIG. 1A shows a preferred form of the invention, wherein a pair of truck cranes 11 are driven onto a platform 10 in side-by-side relation. This form of truck crane utilizes a boom and mast mounting assembly 110 which is formed at the rear end of the truck frame. The boom and mast mounting assembly 110 is in turn supportable by a pair of outriggers 31. Outriggers 31 are adjustably positioned for support on the top surface 12 of platform 10, to transfer the full lifting forces of the boom directly to platform 10. A pair of middle outriggers 131, and a pair of front outriggers 231 stabilize and support truck crane 11 on platform 10. A counterweight 29 is also directly supported on platform 10, and the loading forces transferred through the respective booms are essentially borne by platform 10. The loading forces imparted to the truck crane structure is minimized, and this form of invention has the overall effect of increasing the loading capacity of the truck crane beyond its usual limits. For example, a truck crane having a capacity rating of 350 tons can be increased, through the arrangement shown in FIG. 1A, to a load capacity of approximately 500 tons. Further, when a pair of truck cranes are positioned in side-by-side relation on platform 10, their combined load capacity can be increased to approximately 1,000 tons. Therefore, the embodiment shown in FIG. 1A will permit a 350-ton truck crane to be operated with a 500-ton load capacity, and will permit two 350-ton truck cranes to be operated simultaneously with approximately a 1,000-ton load capacity.

The alternative embodiment shown in FIG. 1C illustrates the invention in conjunction with another form of truck crane, or pair of truck cranes mounted in side-by-side relation on platform 10. Truck crane 11A has a boom and mast mounting assembly 112 which is formed directly on the truck crane frame. The load forces of the boom and mast assembly are therefore transmitted through the truck crane frame, and through the outriggers which support the truck crane frame on platform 10. If a pair of truck cranes of the type shown in FIG. 1C were mounted in side-by-side relation on platform 10, and assuming each truck crane had a 350-ton capacity, the total capacity of the overall assembly would be 700 tons. This load-carrying capacity is lower than that shown in the embodiment of FIG. 1A because the lifting forces are transmitted through the truck crane itself in the embodiment shown in FIG. 1C.

FIG. 1B illustrates an equalizing beam assembly 38 which is usable with either form of the invention described hereinabove. Equalizing beam 38 has a pair of sheaves 115 and 116, each respectively connected to one of the booms of the truck cranes on platform 10, and it has a main hook 117 for load lifting forces. For example, rope cables 54 can connect equalizing beam 38 to boom 33 of the truck crane shown in FIG. 1A, and rope cables 154 can connect equalizing beam 38 to the corresponding boom on a second truck crane positioned in side-by-side relation on platform 10.

Figure 3B:
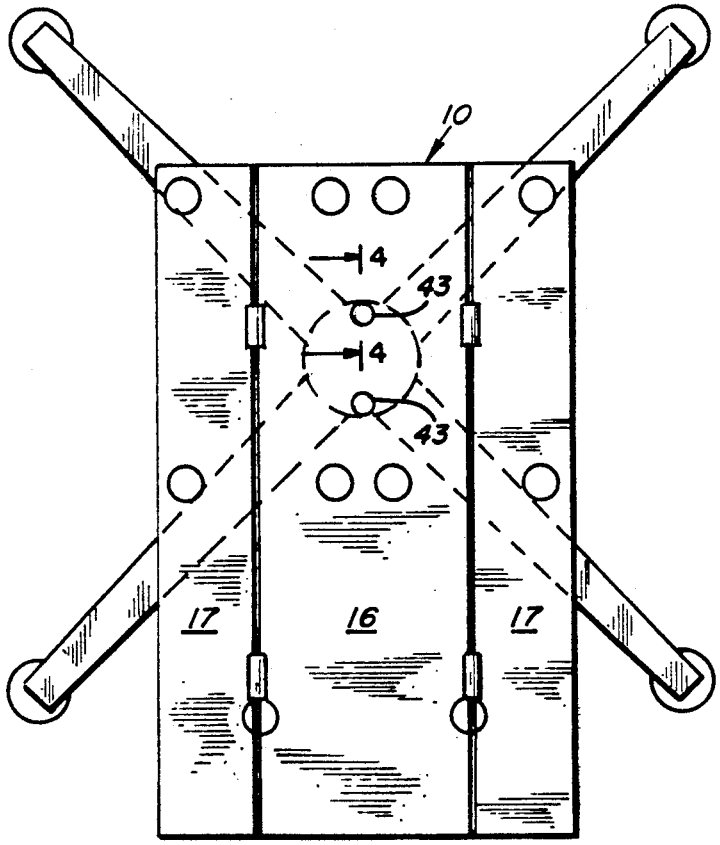
FIG. 3B is a top view of the platform of the present invention.
Figure 6:
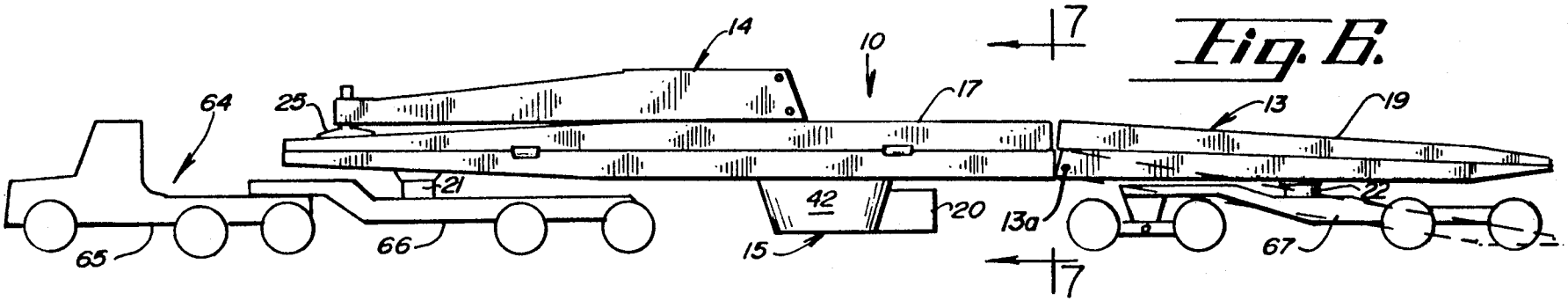
FIG. 6 is an elevation view of the folded platform of the present invention.
Figure 5:
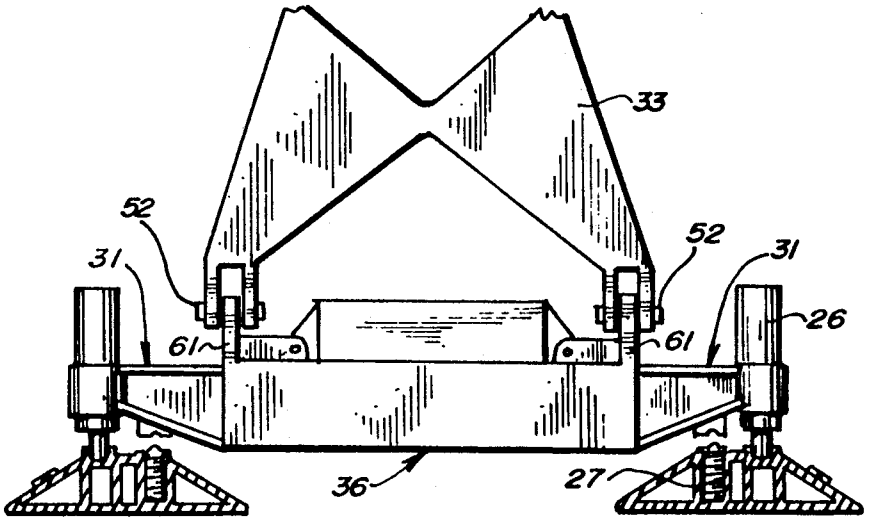
FIG. 5 is a partial cross-section view taken along the lines 5—5 of FIG. 1A.

One form of the platform is described herein and is referred to generally as 10. It should be understood that when the platform 10 is used in combination with certain standard components of commercially available truck cranes or crawler cranes 11, a high-capacity lift crane assembly is created, as shown in the figures. The platform 10 has as its principal parts, a platform surface 12, a rearwardly positioned ramp surface 13, outriggers 14 and a high-capacity swing assembly 15. The platform surface 12 consists generally of a central platform area 16 and a pair of pivotally connected platform sides 17 (FIG. 3B). The ramp 13 consists generally of a central ramp area and a pair of pivotally connected ramp sides 19 (FIG. 6). The ramp 13 is pivotally connected to the platform 10 at pivot point 13*a*. Attached to the bottom surface of the platform 10 is a swing assembly 15, an auxiliary power unit 20 and a kingpin 21. A similar kingpin 22 is attached to the bottom surface of ramp 13 (see FIG. 6). Each outrigger 14 is releasably attached to the tub housing 42 of the swing assembly 15 by a pair of outrigger pins 23 and consists of an outrigger beam 24 and an outrigger foot 25. The outrigger foot 25 includes an adjustable hydraulic cylinder 26 and mechanical safety screw 27, as shown in FIG. 5, relative to similar apparatus mounted on a truck crane. The swing assembly 15 is centrally positioned along the width dimension of the platform surface 12 and located along the length dimension of the platform 10 between the center point of the platform 10 and the rear end of the platform 10 adjacent to the ramp surface 13.

Figure 3A:
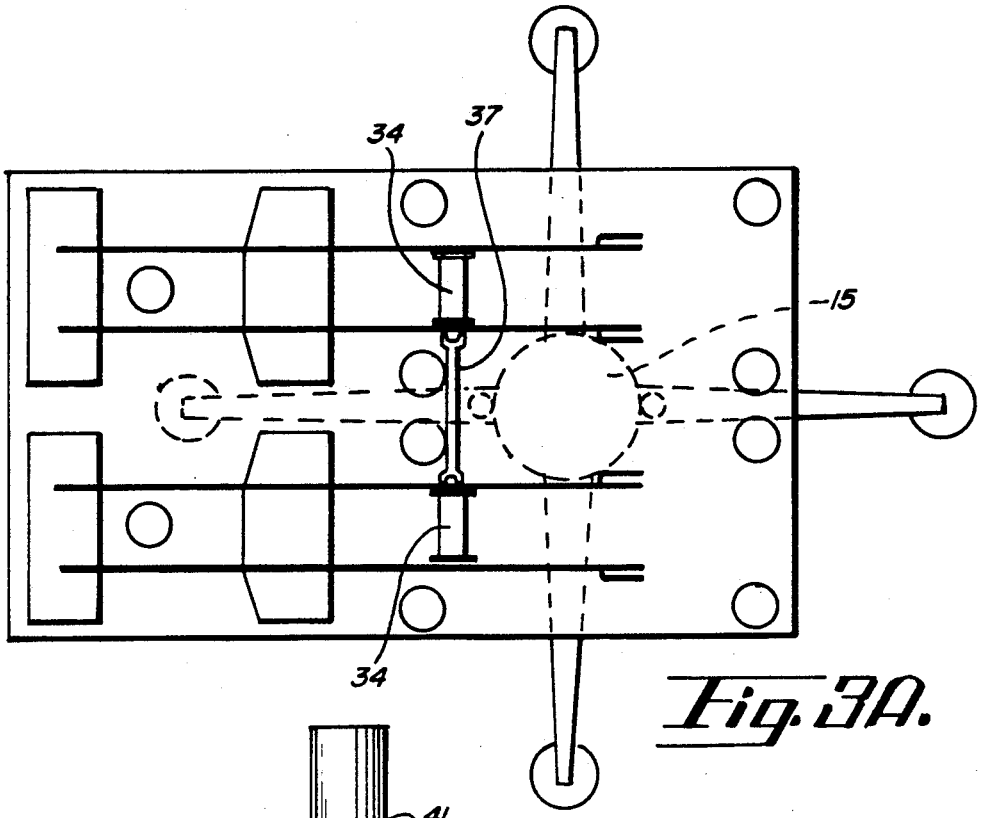
FIG. 3A is a schematic top view of the invention.
Figure 4:
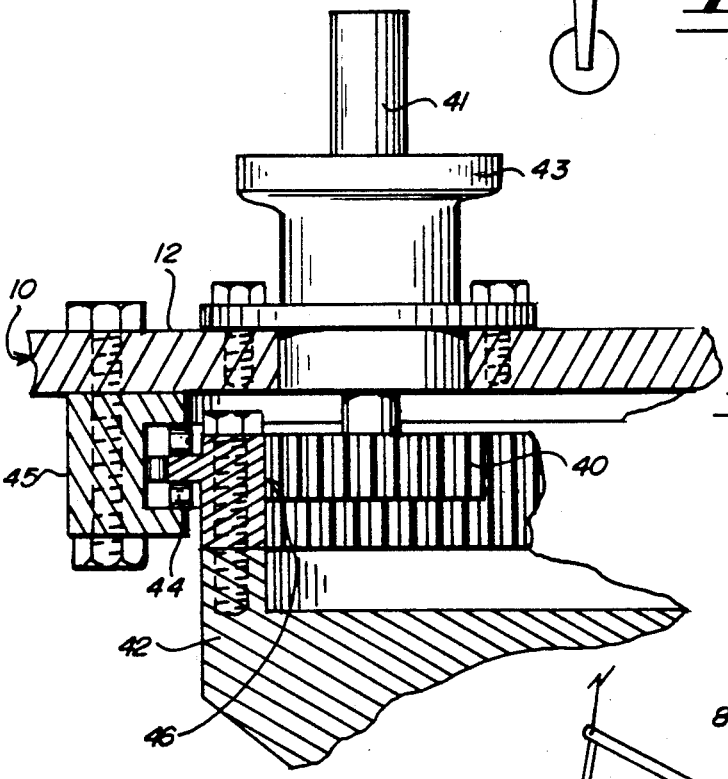
FIG. 4 is a partial cross-sectional view taken along lines 4—4 of FIG. 3B.

The swing assembly 15, as shown in FIGS. 3A, 3B and 4, includes as its primary components, a pair of standard swing gears 40, hydraulic motors 41, gear boxes 43, and a lower tub housing 42. One type of standard swing gear 40 adaptable for use in the present invention is the MOBILEX swing gear, model GFB-G manufactured by Lohmann and Stolterfoht of West Germany. The hydraulic motors 41 extend above the platform surface 12 and are positioned between the truck cranes 11 in their operational position. The auxiliary power unit 20 controls the operation of the components of the tub assembly 15 and is connected to a control panel (not shown) preferably located on the tub assembly. A plurality of roller bearings 44 are mounted about the outer periphery of lower tub housing 42, riding on a circumferential groove formed along the inside surface of bearing housing 45. Bearing housing 45 is affixed to the undersurface of platform 10. Swing gears 40 are engaged into an endless gear track arranged around the inner periphery of lower tub housing 42, so that activation of hydraulic motor 41 will cause the rotation of swing gears 40, thereby causing swing gears 40 to track about the inner periphery of tub housing 42. Since tub housing 42 is affixed to outriggers 14, the result is that platform 10 rotates about tub housing 42, supported by the plurality of roller bearings 44.

Figure 2:
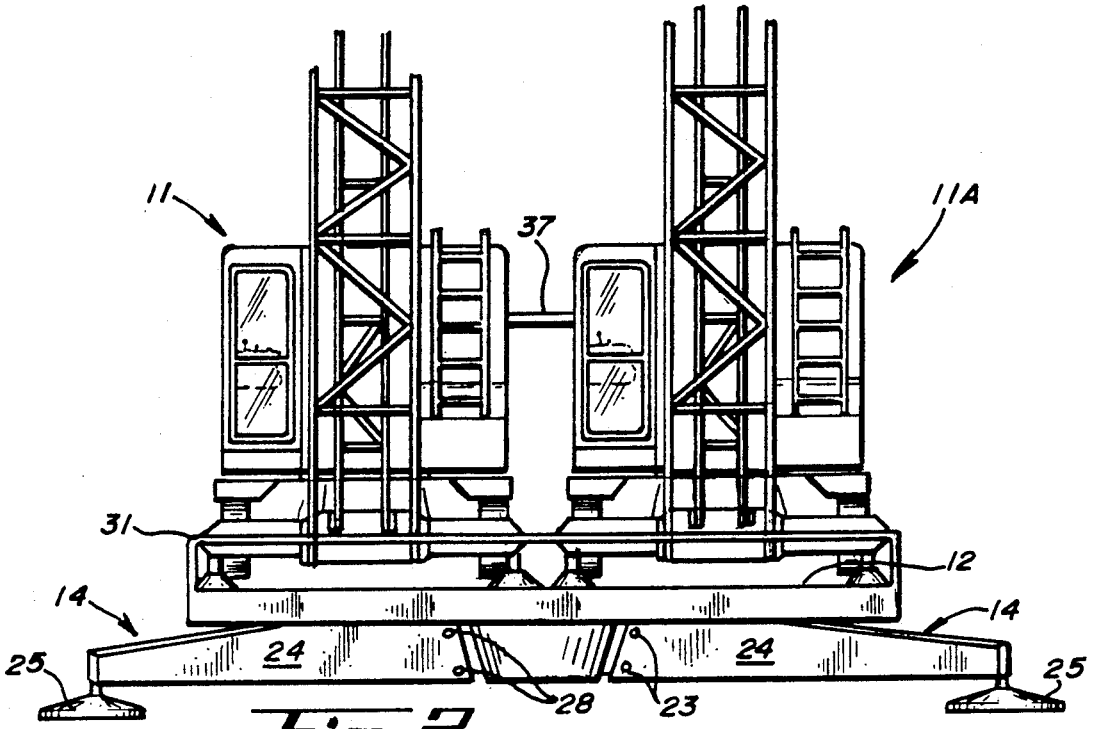
FIG. 2 is a partial front elevation view of the present invention.

The truck cranes 11 of the present invention include counterweights 29, truck cabs 30, outriggers 31, masts 32, booms 33, hoists 34, retractable A-frames 35 and an outrigger housing 36. Additionally, once the respective truck cranes 11 are placed in their side-by-side relation on the platform 10, as shown in FIGS. 2 and 3A, a drive shaft 37 is engaged between the hoists 34 of the respective truck cranes 11 to synchronize and coordinate the rotation of the hoists 34 on each truck crane 11. Additionally, the center point equalizing beam 38 (FIG. 1B) is used on the lift lines of the respective booms 33 to equalize the lifting forces from the respective truck cranes 11.

Figure 7:
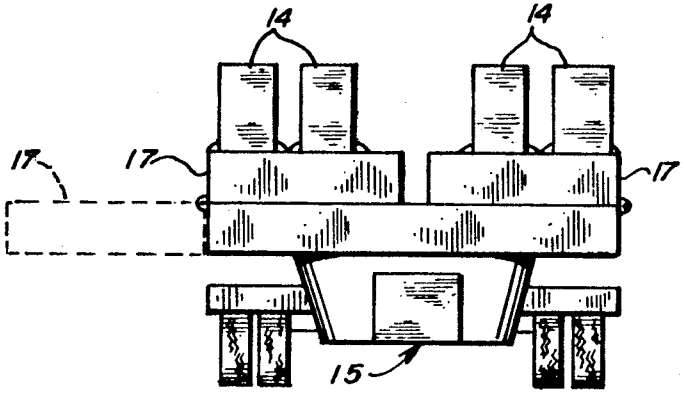
FIG. 7 is a cross-sectional view taken along lines 7—7 of FIG. 6.

FIGS. 6 and 7 illustrate the platform 10 in its folded, transportable arrangement on a standard nine-axle heavy hauling system 64. The heavy hauling system 64 consists of a standard truck 65; a front, two-axled dolly 66 and a rear four-axled dolly 67. The platform 10 is easily assembled and removed from the heavy hauling system 64 by nearly any type of construction equipment having the ability to lift an object; however, to limit the amount of equipment necessary to assemble the present invention, the use of a truck crane 11 is preferred. The outriggers 14 are first removed from the top of the folded platform 10 by a truck crane and then aligned with the tub housing 42. The outriggers 14 are then attached to the outer surface of the tub housing 42 by inserting the outrigger pins 23 into the inner ends of the outrigger beams 24 (FIG. 2). The outrigger feet 25 are then adjusted to support the platform 10 slightly above the platform 10 transport position. The truck 65 and front dolly 66 are then released from the front king pin 21 and moved to a different location. The platform sides 17 are then pivoted into their operational position to form a generally planar surface with the central surface 16 of the platform 10. The truck crane may then lift the rear section of the ramp 13 to remove rear dolly 67 from engagement with the rear king pin 22. Once the rear dolly 67 is removed, the truck crane lowers the rear section of the ramp 13 to the ground to create an inclined ramp surface having an incline of approximately 15 degrees. Finally, the truck crane pivotally lifts the ramp sides 19 into their operational position to form a generally planar surface.

The next step in erecting the high-capacity crane assembly of the present invention is to drive either one or both of the truck cranes 11 onto the platform 10. If the operator has a third crane available, both truck cranes 11 may be driven onto the platform 10 and a third truck crane (not shown) may be used to attach the mast 32 and boom 33 to the first two truck cranes 11. Otherwise, one truck crane 11 may be driven onto the platform and the second truck crane, with its standard boom arrangement may be used to assemble the first truck crane 11. The previously assembled first truck crane 11 may then be used to erect the mast 32 and boom 33 of the second truck crane 11A.

The procedure for the assembly of the truck cranes of the present invention is designed to follow the same procedure for the assembly of a standard high-capacity crane. Initially, the retractable A-frame 35 is raised to its full extension. The mast 32 is then positioned adjacent to the first truck crane 11 and the second truck crane raises the bottom end of the mast 32 onto the top section of the outrigger horseshoes 61 on the outrigger housing 36 (see FIG. 5). The mast pins are then inserted into the outrigger horseshoes 61 to secure the mast 32 to the outrigger housing 36. Next, the top end of the mast 32 is raised a few feet above the ground by the second truck crane. The mast suspension ropes 48 and blocks 49 are then reeved onto the mast 32. The counterweight pendant 50 is then placed along the top surface of the mast 32 and the boom suspension rope and blocks 51 are then reeved onto the top end of the mast 32. The mast 32 is then raised by retracting the A-frame 35. The mast 32 of the truck crane is then used to assemble and connect the various components of the boom 33. The mast 32 of the first truck crane 11 then lifts the bottom end of the boom 33 onto the lower section of the outrigger horseshoe 61 of the outrigger housing 36. The boom pins 52 are then inserted to secure the boom 33 to the outrigger housing 36. The boom 33 is then raised slightly above the ground to allow a derricking block to be connected to the top end of the boom 33. Next, the mast 32 is raised to a nearly vertical position above the counterweight 29. The counterweight pendants 50 are then attached to the counterweight 29 and the boom 33 is raised to a position approximately 45 degrees above horizontal. After the first truck crane 11 is assembled, the second truck crane is driven onto the platform 10 and the assembly procedure is repeated using the first truck crane 11 to assist in the erection of the second truck crane 11.

Once both truck cranes are assembled, the lift lines 54 and 154 are raised to the top of their respective booms 33 and the drive shaft 37 is installed between the hoists 34 of the truck cranes 11 and 11A to synchronize the rotation of the respective hoists 34. Next, the lift lines are lowered to the ground and the center point equalizing beam 38 is installed onto the ends of the lift lines 54 and 154 to equalize the lifting forces on the respective booms 33.

In the present invention, the truck cranes 11 and 11A are arranged in a side-by-side relation on the platform 10 and the outriggers 14 are retracted to the minimize the width of the platform 10 necessary to accommodate the truck cranes 11. The side-by-side arrangement of the truck cranes 11 increases the side stability of the overall assembly by providing a broader base surface to distribute the side tipping forces. The counterweights 29 of the truck cranes 11 ar preferably removable to allow for the addition of heavier counterweights 29 to increase the overall stability of the assembly whenever a heavy load is to be lifted or moved.

Figure 8:
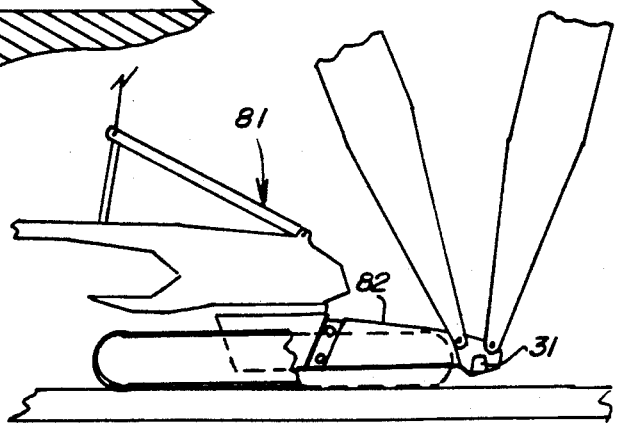
FIG. 8 is a side elevation view of an alternate embodiment of the present invention.

FIGS. 8 and 9 illustrate other forms of the invention wherein the platform 10 is movable to various locations on the job site. FIG. 8 illustrates the use of crawler crane 81, which has a front frame extension 82, attached directly to the outriggers 31. FIG. 9 illustrates the use of a hydraulically suspended wheel system 57, attached to the outriggers 31. In this embodiment, the wheels 58 are preferably suspended by an oil-nitrogen suspension system 59 and include a suspension bracket 60 which attaches directly to the outrigger beam 31. The embodiment illustrated in FIG. 9 increases the side stability of the present invention by providing a wider travel support base for the machines when traveling on a job site with the mast and boom erected.

The fully erected truck cranes 11 may be moved within the same job site independently of the platform 10; however, extreme caution must be exercised whenever the erected truck crane 11 is moved up or down the ramp surface 13. Likewise, if the truck cranes 11 are erected before they are moved onto the platform 10, extreme caution must be exercised when the erected truck crane 11 is moved up the ramp surface 13 onto the platform 10.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. In the combination of a pair of independently operated cranes, each crane including a mast, boom with lift lines, hoist and counterweight thereon, with an assembly for increasing the lifting capacity of said pair of cranes, said assembly comprising:

platform adapted to directly support said pair of cranes and counterweights thereof in a side-by-side arrangement thereon; said platform including a central area and platform sides operatively connected to said central area for movement between a general planar operational position and a transporting position; a ramp surface with central ramp area and ramp sides operatively connected to said central ramp area for movement between a generally planar operational position and a transporting position; means mounting said ramp surface to said central area of said platform; said platform sides and ramp sides when in said operational position being adapted to, respectively, support said cranes and counterweights and to facilitate the movement of said cranes on and off of said platform;

means for rotatably supporting said platform;

a plurality of outriggers, means for releasably attaching said outriggers to said means for rotatably supporting said platform;

means mounted on said platform for rotating said platform in a horizontal plane above said outriggers;

means operatively interconnecting said mast and boom with said hoist and counterweight of said cranes;

a single lift means connected to the lift lines of the respective booms for lifting an object, and means operatively interconnecting the respective hoists of said cranes so that said hoists are operated simultaneously to raise and lower said single lift means.

2. The combination of claim 1 wherein the means for operatively interconnecting the hoists further comprises means for synchronizing the hoists to enable the cranes to lift an object in unison.

3. The combination of claim 1, wherein the hoists are interconnected by a drive shaft to synchronize the rotation of said hoists.

4. The combination of claim 1, wherein the single means for lifting an object further comprises an equalizing beam to equally distribute the lifting forces from each boom to the object.

5. The combination of claim 1, wherein the cranes each include a frame having an outrigger housing thereon for the attachment of the mast and boom thereto, and means for supporting said outrigger housing on said platform.

6. The assembly of claim 1, further comprising a tub housing attached to said plurality of outriggers, each of said outriggers having an adjustable foot at its distal end;

a ring gear affixed in said tub housing;

said platform rotatable mounted to said tub housing;

at least one hydraulic motor affixed to said platform, said motor having a drive gear extending into contact with said ring gear; and means for activating said at least one hydraulic motor and thereby causing rotation of said platform relative to said tub housing.

* * * * *